United States Patent [19]

Naidus

[11] 4,190,987

[45] Mar. 4, 1980

[54] DOUBLE DOME HEAT AND SMOKE VENT STRUCTURE

[75] Inventor: Edward S. Naidus, Glen Rock, N.J.

[73] Assignee: RCA Corporation, New York, N.Y.

[21] Appl. No.: 857,760

[22] Filed: Dec. 5, 1977

[51] Int. Cl.[2] ..... E04B 7/18

[52] U.S. Cl. ..... 52/1; 49/1; 52/200; 52/232

[58] Field of Search ..... 52/1, 200, 232, 303, 52/304; 49/1, 7, 8

[56] References Cited

U.S. PATENT DOCUMENTS

| | | | |
|---|---|---|---|
| Re. 28,453 | 6/1975 | Sandow | 52/200 |
| 3,387,414 | 6/1968 | Adams | 52/232 |
| 3,417,522 | 12/1968 | Kiekhaefer | 52/200 |
| 3,918,226 | 11/1975 | Naidus | 52/232 |
| 3,924,372 | 12/1975 | Anghinetti | 52/232 |

FOREIGN PATENT DOCUMENTS

| | | | |
|---|---|---|---|
| 1434133 | 9/1969 | Fed. Rep. of Germany | 52/200 |
| 2154678 | 5/1973 | Fed. Rep. of Germany | 52/200 |

*Primary Examiner*—James A. Leppink
*Assistant Examiner*—Henry E. Raduazo
*Attorney, Agent, or Firm*—Samuel Cohen; William Squire

[57] ABSTRACT

A double dome thermoplastic fully enclosed skylight structure is heat softenable for opening the heat and smoke vent to the ambient in case of extraordinary temperature elevation in the vicinity of the skylight structure. The inner dome has a plurality of holes for circulating hot air to the space between the two domes for softening the outermost dome. To provide thermal insulation during normal use the holes are sealed with a heat shrinkable thermoplastic film which shrinks in the presence of the elevated temperatures thus opening the holes at that time.

8 Claims, 4 Drawing Figures

DOUBLE DOME HEAT AND SMOKE VENT STRUCTURE

The present invention relates to heat and smoke vent structures.

Double dome thermoplastic skylight structures are well-known in the skylight art. They usually are formed of two sheets of thermoplastic material which are nested together to form a dome-like structure to enclose an opening in the wall or roof of a building. There presently has arisen a demand for less costly heat and smoke vent structures made out of thermoplastic materials which soften and fall through a smoke and heat vent opening in a building in the presence of elevated air temperatures e.g., 300–500 F°, within a short time interval, for example five minutes. One form of heat and smoke vent structure comprises a skylight dome made of a single sheet of thermoplastic material. In the presence of excessive heat this dome softens, shrinks, and falls out of the opening.

Similar double dome structures have not been effective in this application. To meet fire protection standards and other regulations, the domes are required to respond to the elevated temperature and fall out of the opening within a relatively short period of time even when subjected to the cooling effects of ice, snow or rain. Due to thermal insulating effect provided by the dead air spaced between double domes of these structures, the outer dome does not receive sufficient heat within a specified time interval to soften and fall through the opening.

A problem associated with the heat and smoke vent thermoplastic skylight structure is that during rainy weather the cooling effect of rain water on a single sheet dome tends to retard the softening of the sheet beyond the specific time interval. To overcome this problem a second smaller sheet of thermoplastic is placed over the central portion the skylight dome forming a rain shield. When the full size thermally activated dome member responds to heat and softens, it falls through the vent opening. Because the rain shield sitting on top of the dome is smaller than the vent opening, the rain shield need not and does not soften in the presence of heat and falls immediately through the opening along with the full size dome. However, due to the smaller size of the rain shield not as much thermal insulation is provided in this type of dome as in the full double dome structure.

A structure embodying the present invention comprises a full double dome thermal insulating vent structure in which the inner dome has a plurality of spaced holes for circulating heat to the otherwise dead spaced between the two domes for softening the outer dome which ordinarily is not exposed to the heat. To maintain the thermal insulating qualities of the dead air spaced normally present between two domes the holes are covered with heat softenable, heat shrinkable means which open the holes only in the presence of excessive heat.

Figure 1:
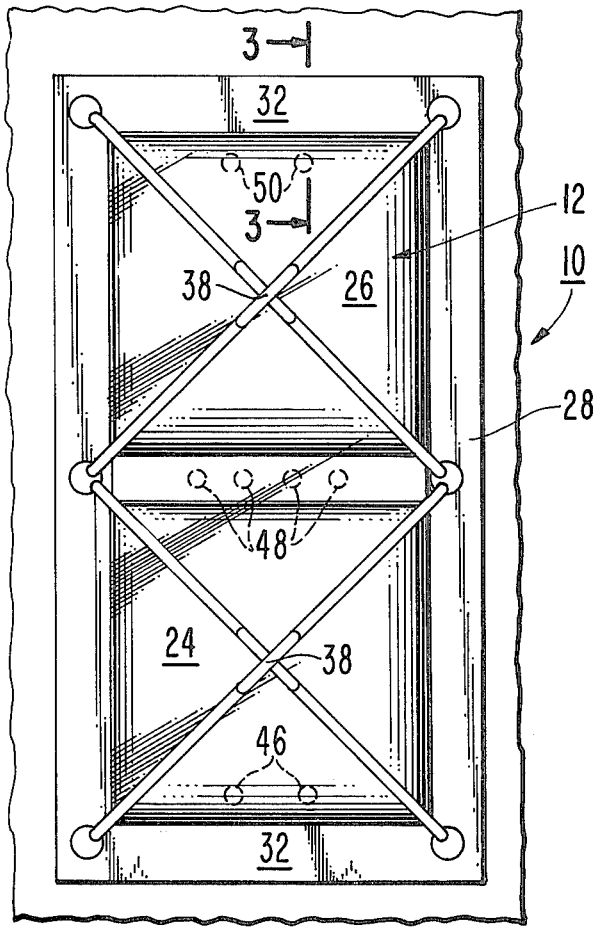
FIG. 1 is a plan view of a skylight structure embodying the present invention.

in FIG. 1 skylight vent 10 includes a full double-dome thermoplastic structure 12. Each structure 12 is formed of a pair of sheets and each sheet may be of the type described in my U.S. Pat. No. 3,918,226 assigned to the same assignee of the present invention. In particular FIG. 7 of that patent illustrates a vent similar to 10 but where each structure corresponding to 12 is formed of a single plastic sheet.

Figure 4:
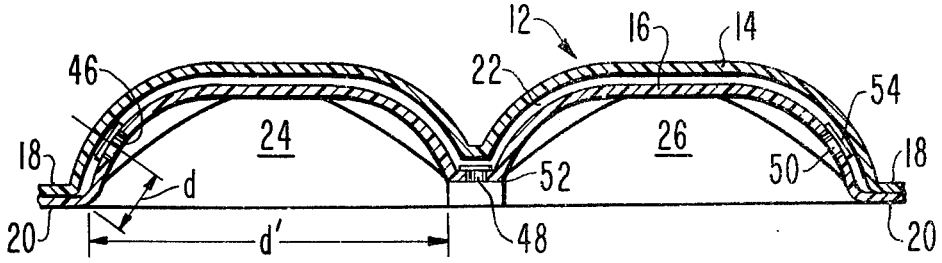
FIG. 4 is a sectional elevational view of the double dome construction used in the embodiment of FIG. 1.

In the present vent, as shown in FIG. 4, the dome structure 12 comprises two plastic members 14 and 16. Member 14 is disposed above member 16 with the outer surface of 14 exposed to the ambient and the inner surface of member 16 facing the interior of the enclosure from which the heat and smoke is to be vented. For example, structure 12 may enclose an opening in a roof of a building. Any heat softenable construction of the members 14 and 16 may be used with the present invention as, for example, the structure described in the aforementioned U.S. Pat. No. 3,918,226. Member 14 has a peripheral flange 18 the lower surface of which lies on the upper surface of peripheral flange 20 of the lower member 16. Member 14 is spaced from the member 16 over the dome area (see FIG. 4), to provide a dead air space 22 between the two members. Dead air space 22 provides thermal insulation between the enclosed building interior and the ambient.

While the dome structure 12 is illustrated as having the two sections 24 and 26 of like construction where each section comprises crossed troughs as described in more detail in U.S. Pat. No. 3,918,226, it is equally apparent that a single section formed by either section 24 or section 26 may incorporate features of the present invention to be described. The rigidity or stiffness of each of members 14 and 16 is sufficient to maintain them in their spaced relationship. However, thermal insulating spacers (not shown) may be provided at spaced locations between members 14 and 16 to keep the two elements apart by a desired amount. Such spacers may be fixed to either one or both of members 14 and 16, if desired.

Structure 12 is mounted in a frame and curb assembly 28 which is secured to a roof 30. The frame and curb assembly 28 may be of any suitable design for use with a releasable fire vent thermoplastic member. Preferably, frame and curb assembly 28 is of the type disclosed and described in my copending application with Charles Wheeler Clark, for an invention in a skylight frame structure, Ser. No. 766,563 filed Feb. 7, 1977 and assigned to the same assignee of the present invention. Disclosed therein is a curb and frame construction for mounting a thermoplastic skylight member which serves as a heat and smoke vent. That frame is modified as shown by the assembly 28, FIG. 3, to include sufficient room between apron 32 and lip 34 to receive the two juxtaposed flanges 18 and 20. This is accomplished by increasing the height of spacers 36. In other respects, the construction of the curb and frame assembly may be similar to that of the copending application.

A suitable personnel safety aluminum cross brace construction 38 is provided on top of the dome member 12 in the interest of personnel safety and forms no part of the present invention. The brace construction 38 may be fixed to the frame and curb assembly 28.

Figure 3:
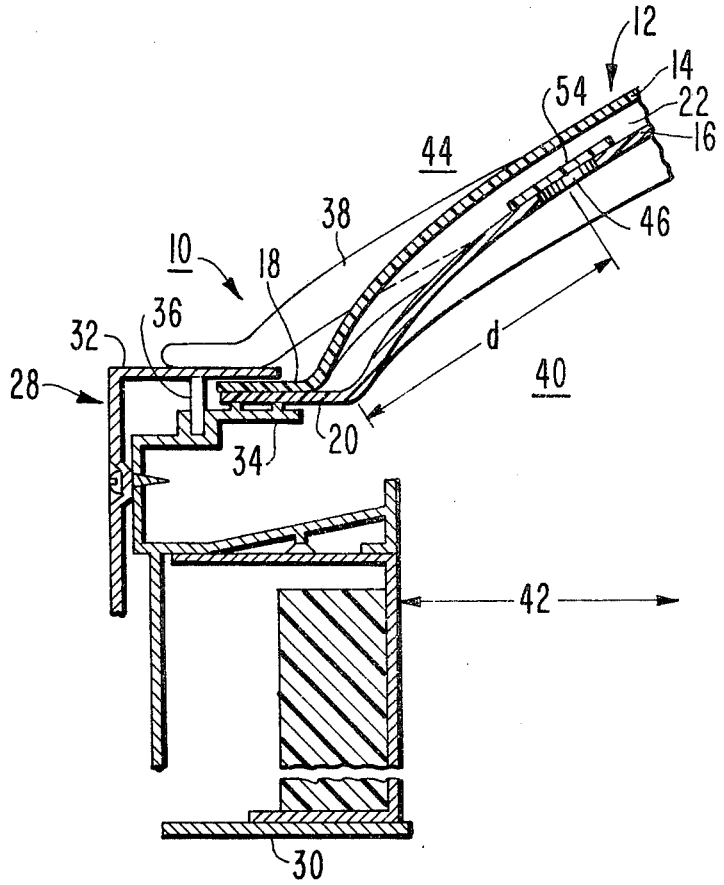
FIG. 3 is a sectional view taken along lines 3—3 in FIG. 1.

As discussed in the introductory portion of this application, the insulation provided by the dead air space 22 in a double dome normally delays the softening of outer member 14, when there is a fire within the building. While the inner member 16 may shrink and soften in the presence of excessive heat, the heat in contact with member 14 may be insufficient to soften and shrink member 14 within a standard time inerval which may be specified in a building code. This, of course, is undesirable because it delays the venting of opening 42 to the ambient 44 (FIG. 3).

Figure 2:
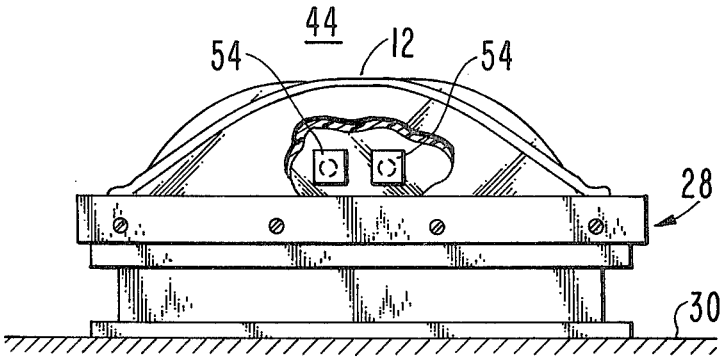
FIG. 2 is an end partial cutaway elevational view of the structure of FIG. 1.

In accordance with the present invention, a plurality of holes 46, 48 and 50 are provided in the inner dome member 16. In a skylight which is approximately 4 feet by 8 feet in perimeter, the holes 46, 48, and 50 preferably have a diameter of about 1⅛ inches at minimum. Holes 46 and 50 are similar and are placed symmetrically spaced relative to the center-line of the dome adjacent the apron 32 as shown in FIGS. 1 and 2. The centers of holes 46 are spaced from flange 20 a distance d which is approximately 10 to 20 percent of the width d' of one of the sections 24 and 26, FIG. 4. For example, for a dome in which the sections 24 and 26 are each approximately 4 feet by 4 feet the holes 46 and 50 have a dimension of which may be approximately 6 inches. The position of the holes 46 or 50 along the width dimension of the sections (FIG. 2) is not critical. In the design above, the holes were spaced approximately one foot apart center-to-center, and were symmetrical relative to the longer center-line of the vent 10.

The four holes 48 may also each have a diameter of about 1⅛ inch minimum in a 4 foot by 8 foot skylight and then may be spaced 9 inches apart center-to-center. These holes are disposed in the intermediate member 52 joining sections 24 and 26 of member 16 and are also symmetrical relative to the longer center line of the vent.

The holes 46, 48 and 50 tend to provide air circulation in the dead space 22. Such air circulation, in the absence of excessive heat in the interior 40 is undesirable in that the circulation diminishes the thermal insulating characteristics that ordinarily would be afforded by the dead air space 22. Such circulation is prevented in the present construction by the thermoplastic film 54 which covers each of the holes 46, 48 and 50. Each such film may be square or of other suitable shapes and may be made of a heat shrinkable, commercially available plastic material and cemented to member 16. Film 54 may be, for example, a polymethacrylate, flexible heat shrinkable film 3 mils thick manufactured under the trade name "Korad" by Excell Corporation of Newark, N.J. The cement may be a suitable acrylic rubber base cement. The films 54 are disposed in the dead space 22. Each film 54 has the property that in the presence of elevated temperatures it shrinks and shrivels to the point where it disengages from the member 16, opening the respective holes 46, 48 and 50. The response of the film is such that it reacts quickly within a few seconds of exposure to elevated temperatures, so as to quickly open the holes. Thus, under normal operating conditions, the holes 46, 48 and 50 are sealed and spaced 22 is a dead air space providing a good thermal insulating characteristics the double dome structure 12.

Once a fire becomes active within a building, the heat rises rapidly to the ceiling and heats the very thin heat shrinkable films 54. They almost immediately, shrivel, opening the holes and permitting the hot air to enter the space 22. The spaced holes 48 and 50 permit circulation of this hot air due to pressure differentials. That is, some of the hot air may enter the space 22 through the holes 48 and leave through the holes 46 and 50. Other flow paths for hot air through space 22 also are possible. The important aspect is that the heated air immediately enters the space 22 and provides heat to the member 14. Members 14 and 16, in the presence of a given amount of heat, tend to soften, sag and shrink. Upon the occurrence of sufficient shrinkage and sagging, the members 14 and 16 slip out of the cavity formed by apron 32 and lip 34 and fall into the opening 42 thereby opening the space 40 to the ambient 44.

There has thus been shown a double dome construction for venting heat and smoke from a building interior to the ambient while providing good thermal insulation characteristics. The desirable thermal insulation characteristics of the double dome is maintained for ordinary use and yet the heat barrier is overcome automatically in the case of excessive interior heat.

What is claimed is:

1. A vent structure for enclosing a heat and smoke vent opening comprising:

a first heat softenable and heat shrinkable sheet member having a peripheral edge circumscribing said opening, a second heat softenable and heat shrinkable sheet member having an edge over said peripheral edge of said first member, said second member being positioned spaced from and coextensive with said first member forming a dead space therebetween, the one of said members facing the heat to be vented through said vent opening and having a plurality of spaced holes for providing heat circulation to said dead space for softening the other of said members and the other of said members being continuous in the sense it prevents the escape of heat passing into the dead space prior to its softening, and heat softenable heat shrinkable means which opens said holes in response to said heat applied thereto enclosing said holes for enclosing said dead space to provide thermal insulation in the absence of said heat to be vented.

2. The structure of claim 1 wherein said sheet memers are formed into a pair of nested skylight members and made of material adapted to shrink and fall into said opening upon softening.

3. The structure of claim 1 wherein said heat shrinkable means is a thermoplastic film cemented to said one member.

4. A heat and smoke vent skylight structure comprising:

a first heat softenable and heat shrinkable thermoplastic skylight sheet member, a second heat softenable and heat shrinkable thermoplastic skylight sheet member spaced from the first member and secured to the first member at the outer edges thereof to form a dead air space therebetween, the inner one of said members having a plurality of spaced holes for providing circulation of heat to the other outer one of said members so that said outer member will soften when the inner one member is exposed to heat and the other of said member being continuous in the sense it prevents the escape of heat passing into the dead space prior to its softening, and heat-softenable, heat-shrinkable hole closing means enclosing said holes for maintaining said dead air space except when said inner one member is exposed to heat sufficient to soften and shrink said hole closing means and open said dead air space to said heat.

5. A heat and smoke skylight vent structure for attachment to a wall in which there is a heat and smoke vent opening comprising:

a pair of nested spaced skylight dome members made of heat softenable thermoplastic sheet material, said members terminating at their edges in a peripheral edge surrounding said members and releasably secured to said wall, a plurality of spaced holes formed in the inner one of said members said holes being positioned on opposite sides of the dome formed by said members, and a heat shrinkable thermoplastic film secured over said holes for sealing the space between said members from the ambient.

6. A heat and smoke skylight structure for attachment to a wall in which there is a heat and smoke vent opening comprising:

a pair of nested spaced skylight dome members made of heat softenable and heat shrinkable thermoplastic sheet material, said members terminating at their edges in a peripheral edge surrounding said members and releasably secured to said curb, and a plurality of spaced holes formed in the inner one of said members, said holes being positioned on opposite sides of the dome formed by said members, the other of said members being continuous in the sense it prevents the escape of heat passing through said holes into the space between the members to permit the softening of said other member in the presence of said heat.

7. A heat and smoke vent skylight structure comprising:

a first heat softenable and heat shrinkable outer thermoplastic skylight sheet member, and a second heat softenable and heat shrinkable inner thermoplastic skylight sheet member spaced from the first member and secured to the first member at the outer edges thereof to form an air space therebetween, the inner one of said members having a plurality of spaced holes for providing circulation of heat at a temperature sufficiently above ambient to the outer one of said members so that said outer member will soften when the inner one member is exposed to said heat, the outer one of said members being continuous in the sense it prevents the escape of heat passing through said holes into said air space prior to its softening.

8. A vent structure for enclosing a heat and smoke vent opening comprising:

a first heat softenable sheet member having a peripheral edge circumscribing said opening, a second heat softenable sheet member having an edge over said peripheral edge of said first member, said second member being positioned spaced from and coextensive with said first member forming a dead space therebetween, one of said members facing the heat to be vented through said vent opening and having a plurality of spaced holes for providing heat circulation to said dead space for softening the other of said members, and heat softenable heat shrinkable thermoplastic film means cemented to said one member which opens said holes in response to said heat applied thereto enclosing said holes for enclosing said dead space to provide thermal insulation in the absence of said heat to be vented.

* * * * *